US011083294B2

(12) United States Patent
Borquez et al.

(10) Patent No.: US 11,083,294 B2
(45) Date of Patent: Aug. 10, 2021

(54) SLIDE ASSEMBLY

(71) Applicant: Jonathan Manufacturing Corporation, Irvine, CA (US)

(72) Inventors: Oscar Sadot Borquez, Corona, CA (US); Patty J. Amechi, Eugene, OR (US)

(73) Assignee: Jonathan Manufacturing Corporation, Irvine, CA (US)

( * ) Notice: Subject to any disclaimer, the term of this patent is extended or adjusted under 35 U.S.C. 154(b) by 0 days.

(21) Appl. No.: 16/667,234

(22) Filed: Oct. 29, 2019

(65) Prior Publication Data

US 2021/0120952 A1 Apr. 29, 2021

(51) Int. Cl.
*A47B 88/00* (2017.01)
*A47B 88/487* (2017.01)
*A47B 88/423* (2017.01)

(52) U.S. Cl.
CPC ..... *A47B 88/487* (2017.01); *A47B 88/423* (2017.01)

(58) Field of Classification Search
CPC ..... A47B 88/487; A47B 88/423; A47B 2210/0016; A47B 2210/0018; A47B 2210/0032; A47B 2210/0035; A47B 2210/0091; A47B 88/14; A47B 88/047; A47B 88/0481; A47B 88/10; F16C 29/04; F16C 29/008
USPC ..... 312/334.1, 334.7–334.9, 334.11, 334.16, 312/334.17, 334.37, 334.38, 312/334.44–334.47; 384/18, 20, 21, 22
See application file for complete search history.

(56) References Cited

U.S. PATENT DOCUMENTS 3,059,978 A * 10/1962 Fall ..... A47B 88/493 384/18
3,059,986 A * 10/1962 Miller, Jr. ..... A47B 88/49 312/334.8
3,485,539 A * 12/1969 Fall et al. ..... A47B 88/493 384/19
4,112,539 A * 9/1978 Hagen ..... E05D 15/0643 16/88
4,749,242 A * 6/1988 Rechberg ..... A47B 88/493 312/333
4,872,734 A * 10/1989 Rechberg ..... A47B 88/493 312/333

(Continued)

FOREIGN PATENT DOCUMENTS

BE 846072 * 12/1976
CA 2096189 11/1994

(Continued)

OTHER PUBLICATIONS

International Search Report and Written Opinion for PCT/US2020/056318 dated Feb. 11, 2021 in 15 pages.

*Primary Examiner* — Janet M Wilkens
(74) *Attorney, Agent, or Firm* — Knobbe, Martens, Olson & Bear LLP

(57) ABSTRACT

Slide assemblies are performance enhanced, using unique materials and may include a plastic outer slide segment, a metal intermediate slide segment, a plastic inner slide segment, and/or a plastic chassis member. The metal intermediate slide segment may be slideable relative to the outer slide segment. The plastic inner slide segment may be slideable relative to the intermediate slide segment. The plastic chassis member may be removably coupled to the inner slide segment.

22 Claims, 10 Drawing Sheets

(56) References Cited

U.S. PATENT DOCUMENTS

| | | | | | |
|---|---|---|---|---|---|
| 5,417,496 | A * | 5/1995 | Hobbs | F16C 29/04 | 384/18 |
| D757,141 | S * | 5/2016 | Rechberg | D15/143 | |
| 9,486,077 | B2 * | 11/2016 | Brock | A47B 88/467 | |
| 2008/0218046 | A1 * | 9/2008 | Rechberg | A47B 88/493 | 312/334.11 |
| 2013/0077900 | A1 * | 3/2013 | Lowe | A47B 88/49 | 384/18 |
| 2015/0272325 | A1 * | 10/2015 | Brock | A47B 88/493 | 384/18 |
| 2018/0110334 | A1 * | 4/2018 | Hamon | A47B 88/45 | |
| 2020/0077795 | A1 * | 3/2020 | Rechberg | A47B 88/477 | |

FOREIGN PATENT DOCUMENTS

| | | | |
|---|---|---|---|
| DE | 20113622 | | 9/2002 |
| EP | 0011675 | * | 7/1979 |

* cited by examiner

SLIDE ASSEMBLY

BACKGROUND

Field

The present disclosure relates to slide assemblies.

Description of the Related Art

Slide assemblies are used to movably support one object (e.g., a drawer) relative to another object (e.g., a cabinet or enclosure). Some commercial applications, for example aircraft applications, have weight restrictions. There remains a need for lightweight slide assemblies with improved performance.

SUMMARY

The slide assemblies described herein are light weight, for example by incorporating plastic components. The plastic components may include aircraft grade plastic materials. The slide assembly may include a combination of plastic and metal (e.g., aluminum) components to provide other benefits such as increased load capacity and/or improved performance. For example, the slide assembly may include a plastic outer slide segment, a metal intermediate slide segment slideable relative to the outer slide segment, a plastic inner slide segment slideable relative to the intermediate slide segment, and a plastic chassis member removably or non-removably coupled to the inner slide segment. The outer slide segment may be mounted to a first object such as a cabinet or enclosure, while the plastic chassis member may be mounted to another object such as a drawer.

The slide assembly may include a first set of bearings to allow the intermediate slide segment to slide relative to the outer slide segment and/or a second set of bearings to allow the inner slide segment to slide relative to the intermediate slide segment. The first set and/or the second set of bearings may comprise polymer bearings to provide smoother movement, reduce weight, and/or reduce noise. Bearings may also be comprised of stainless steel to meet aircraft specification (i.e. burn, tox, flame). The slide assembly may also include one or more pins to provide sturdy stops for the ball bearings.

The slide assemblies described herein are configured to move between a first or collapsed configuration and a second or extended configuration. In the collapsed configuration, a length of the slide assembly may be at least about 12 inches long and/or less than or equal to about 30 inches long. A length of the slide assembly may be greater than 30 inches long. The slide assemblies described herein may perform at least 10,000 cycles between a fully extended configuration and a fully collapsed configuration. In the extended position, the inner slide segment may be configured to over travel the outer slide segment, for example by at least 1 inch or more. The inner slide segment may over travel the outer slide segment while carrying at least a 50 pound load. The inner slide segment may carry at least two times the working load as a momentary load in the extended position. The slide assembly may provide these benefits, while still reducing the overall dimensions of the slide assembly. For example, the slide assembly may be configured to within a 1U EIA rack spacing requirement.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No individual aspects of this disclosure are essential or indispensable.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure.

DETAILED DESCRIPTION

Figure 2:
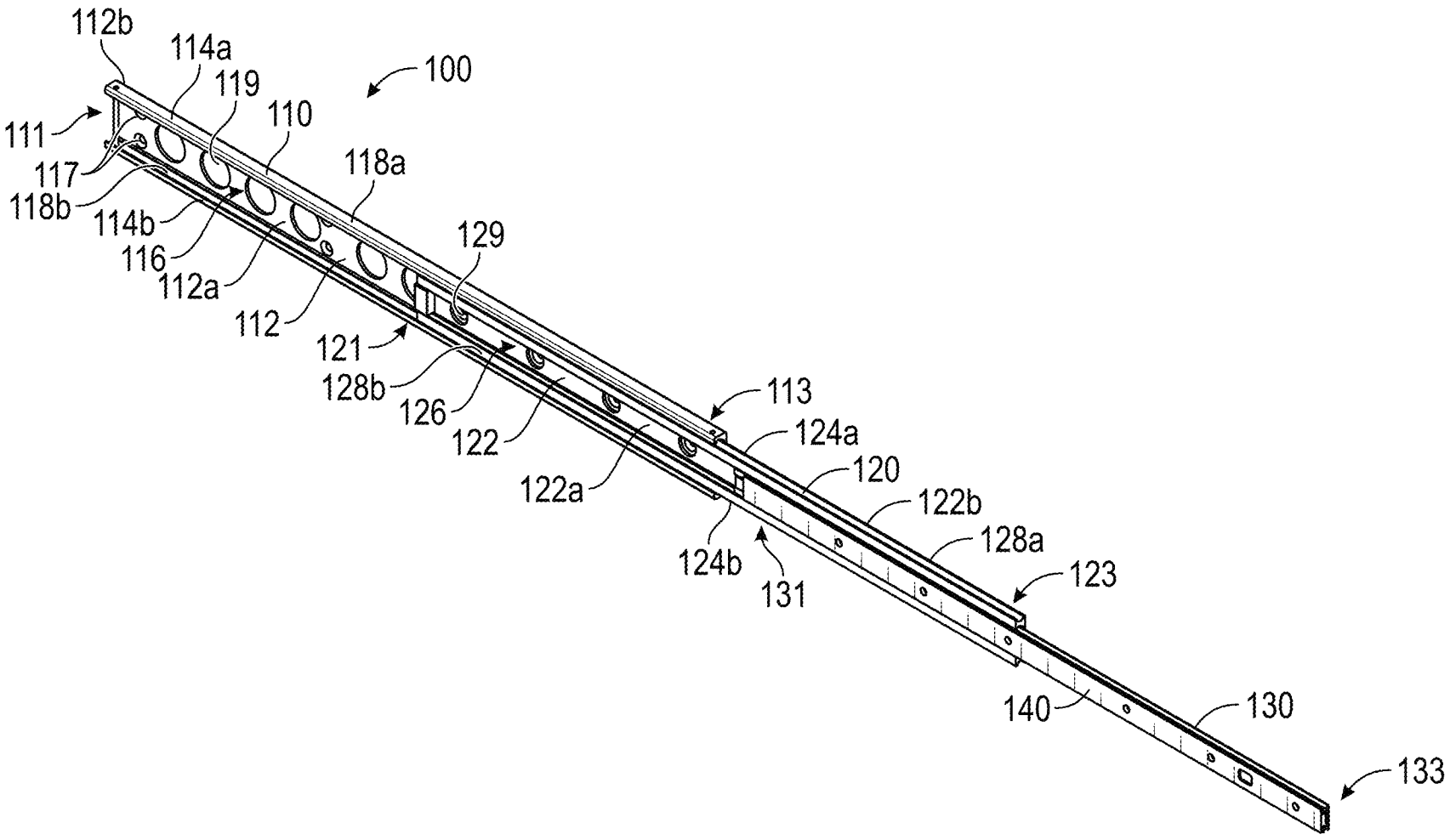
FIG. 2 illustrates a front perspective view of the slide assembly shown in FIG. 1.
Figure 3:
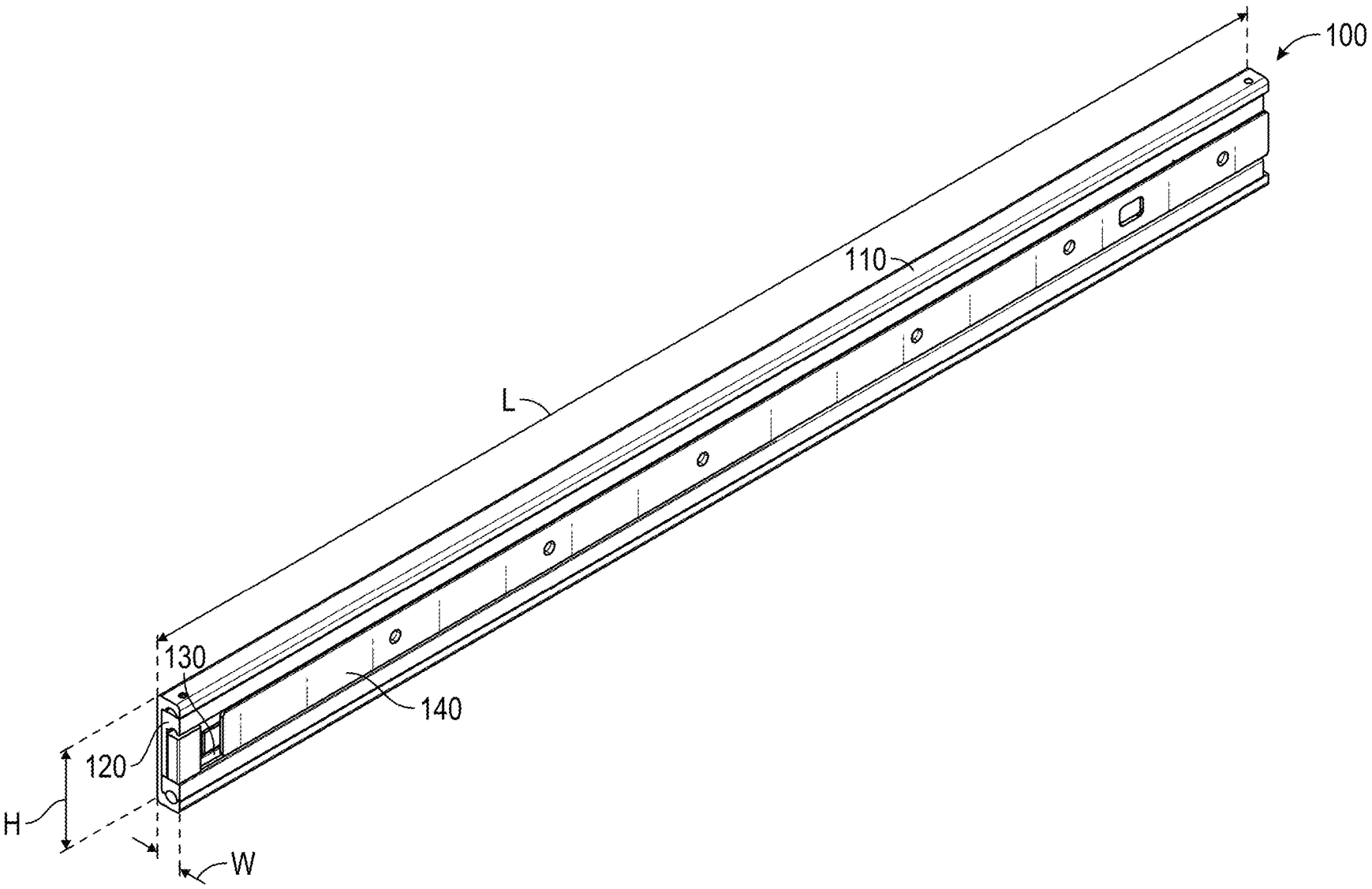
FIG. 3 illustrates the slide assembly shown in FIG. 1 in a collapsed configuration.

The slide assemblies described herein include at least three slide segments telescopically engaged with one another to move between an open or extended position (see FIGS. 1 and 2) and a closed or collapsed position (see FIG. 3). The segments may be any suitable shape to permit telescopic engagement between the segments. Typically, one or more slide assemblies permit one object to be supported and moved relative to another object. One object is often stationary, such as an enclosure or cabinet, and the other object, such as a drawer, is movable between an open and closed position relative to the stationary object. Often, a slide assembly is provided on each side of the supported object.

For convenience, the slide assembly is referred to as having an outer or outboard side and an inner or inboard side. The outer or outboard side typically is positioned closer to the stationary object in a lateral direction relative to the inner or inboard side. Also, the slide assembly is referred to as having a forward end and a rearward end. The slide assembly opens from the forward end and moves away from the rearward end. The slide assembly is also referred to as having an upper portion and a lower portion. These, and other relative terms (top, bottom, above, below, etc.) are used for convenience and with respect to the particular orientation shown in the referenced figures and are not intended to be limiting. Thus, the slide assemblies can also be used in other orientations or applications, or adapted for use in orientations or applications other than those illustrated.

The slide assemblies disclosed herein are well-suited for use in movably supporting drawers relative to an enclosure or cabinet. For example, and without limitation, the illustrated slide assembly is well-suited for use in airplane, commercial, or other similar applications. The slide assemblies described herein are capable of supporting the loads expected by the intended application, and often additional loading, while still maintaining smooth extension and retraction of the slide assembly.

Figure 1:
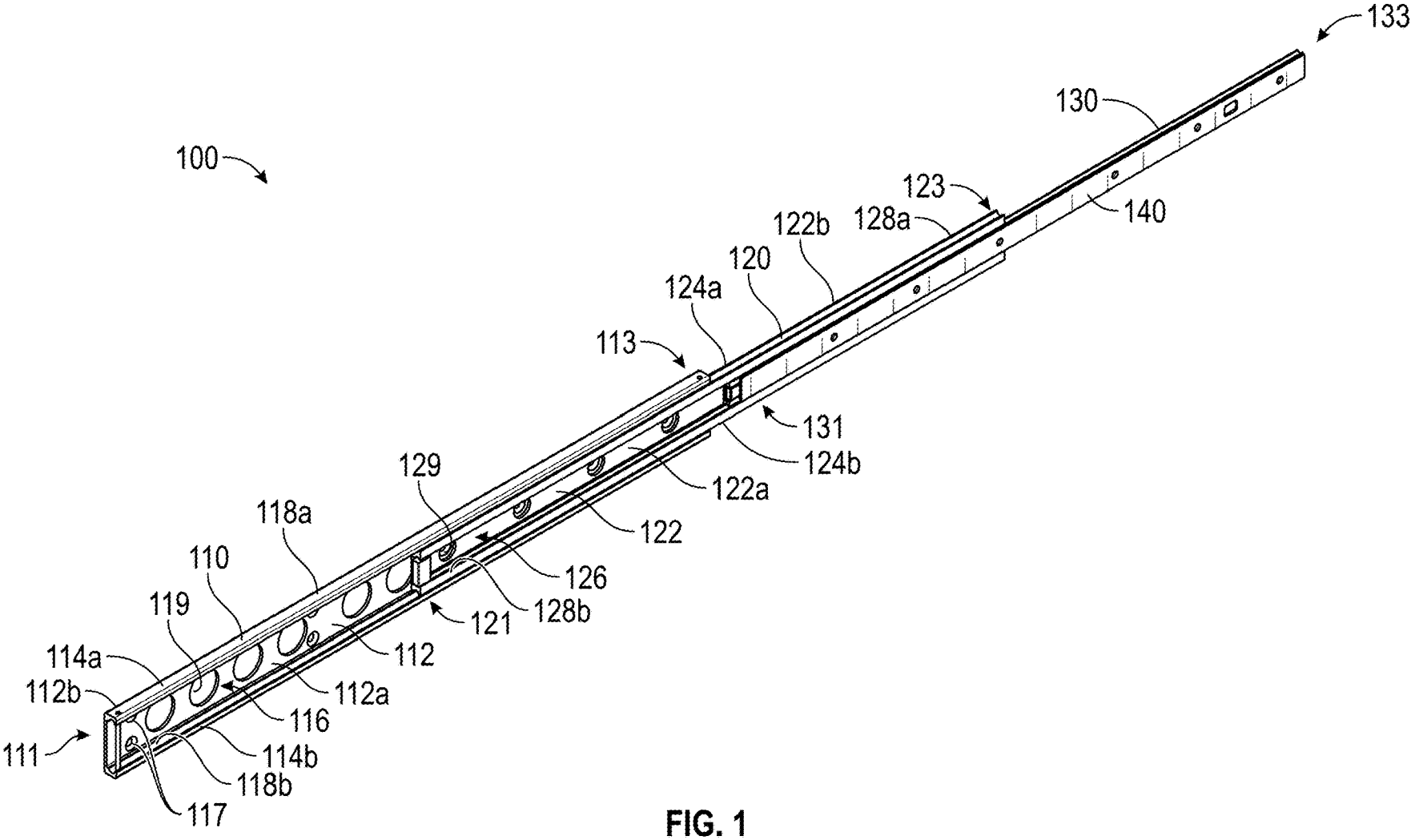
FIG. 1 illustrates a rear perspective view of a slide assembly.

FIGS. 1 and 2 illustrates a slide assembly 100 in an open or extended position. FIG. 3 illustrates the slide assembly 100 in a closed or collapsed position. The slide assembly 100 may be symmetrical along an axis extending through a length of the slide assembly 100 such that the slide assembly 100 may be used as a left hand or a right hand slide. The slide assemblies described herein may perform at least 10,000 cycles between a fully extended configuration and a fully collapsed configuration.

As illustrated, the slide assembly includes an outer slide segment 110, an intermediate slide segment 120, and an inner slide segment 130. The intermediate slide segment 120 is slideable relative to the outer slide segment 110. The inner slide segment 130 is slideable relative to the intermediate slide segment 120. However, in other arrangements, the slide assembly 100 may include only two segments, or more than three segments. In this context, the terms outer, intermediate and inner refer to an orientation of the slide segments relative to one another in accordance with the correspondence with the function of slide segments of a slide assembly. In other words, the inner slide segment 130 is positioned to be connected to the movable object or drawer and the outer slide segment 100 positioned to be connected to the stationary object or cabinet. The inner slide segment 130 may be indirectly coupled to the movable objection, for example using a chassis member 140. However, other arrangements are also possible. Therefore, the terminology is used herein as a convenience and is not intended to be limiting unless indicated otherwise. Certain features of the slide segments may be more clearly shown in the exploded view of the slide assembly 100 in FIG. 4.

The outer slide segment 110 may include a wall portion 112 (also referred to herein as a web) configured to be mounted to a first object such as a cabinet or an enclosure. For example, the web 112 may include one or more mounting structures 117, such as holes, for mounting the outer slide segment 110 to the first object. The web 112 may have an inner surface 112*a* and an outer surface 112*b* opposite the inner surface 112*a*. The web 112 may be generally rectangular in shape. The inner and outer surfaces 112*a*, 112*b* of the web 112 may be generally planar and parallel to each other. The web 112 may include one or more weight reducing features 119, such as holes or indentations, to reduce a total weight of the outer slide segment 110. The weight reducing features 119 may be evenly or unevenly spaced apart across a length of the web 112.

The outer slide segment 110 may include a first flange 114*a* and a second flange 114*b* extending from the inner surface 112*a* of the web 112, for example perpendicular to the inner surface 112*a* of the web 112. The first and second flanges 114*a*, 114*b* may be spaced apart by the web 112 providing a receiving portion 116 therebetween. Each of the first flange 114*a* and the second flange 114*b* may include an outer surface 118*a* and an inner surface 118*b* facing the receiving portion 116. The outer surfaces 118*a* of the first and second flanges 114*a*, 114*b* may be generally planar and parallel to each other. The inner surfaces 118*b* of the first and second flanges 114*a*, 114*b* may include a curvature, for example a concave curvature. The curvature of the inner surfaces 118*b* forms a groove that constrains and/or guides the bearings 160 described further below.

The intermediate slide segment 120 may include a wall portion 122 (also referred to herein as a web) configured to be received within the receiving portion 116 of the outer slide segment 110. The web 122 may have an inner surface 122*a* and an outer surface 122*b* opposite the inner surface 122*a*. The web 122 may be generally rectangular in shape. The inner and outer surfaces 122*a*, 122*b* of the web 122 may be generally planar and parallel to each other. The web 122 may include one or more weight reducing features 129, such as indentations or holes, to reduce a total weight of the intermediate slide segment 120. As illustrated, the weight reducing features 129 are only present on a rear half of the intermediate slide segment 120, but additional features 129 may be provided on the front half of the intermediate slide segment 120. The weight reducing features 129 may be evenly or unevenly spaced apart along the intermediate slide segment 120.

The intermediate slide segment 120 may also include a first flange 124*a* and a second flange 124*b* extending from the inner surface 122*a* of the web 122, for example perpendicular to the inner surface 122*a* of the web 122. The first and second flanges 124*a*, 124*b* may be spaced apart by the web 122 providing a receiving portion 126 therebetween. Each of the first flange 124*a* and the second flange 124*b* may include an outer surface 128*a* and an inner surface 128*b* facing the receiving portion 126. The inner surfaces 128*b* and/or outer surfaces 128*a* of the first and second flanges 124*a*, 124*b* may be include a curvature, for example a concave curvature. The curvature of the outer surfaces 128*a* and/or the inner surfaces 128*b* form a groove that constrains and/or guides the bearings 160 described further below.

When assembled, the outer surface 122*b* of the intermediate slide segment 120 faces the inner surface 112*a* of the outer slide segment 110. A height of the intermediate slide segment 120, measured from the first flange 124*a* to the second flange 124*b*, may be dimensioned to fit within the receiving portion 116 between the first and second flanges 114*a*, 114*b* of the outer slide segment 110.

Figure 4:
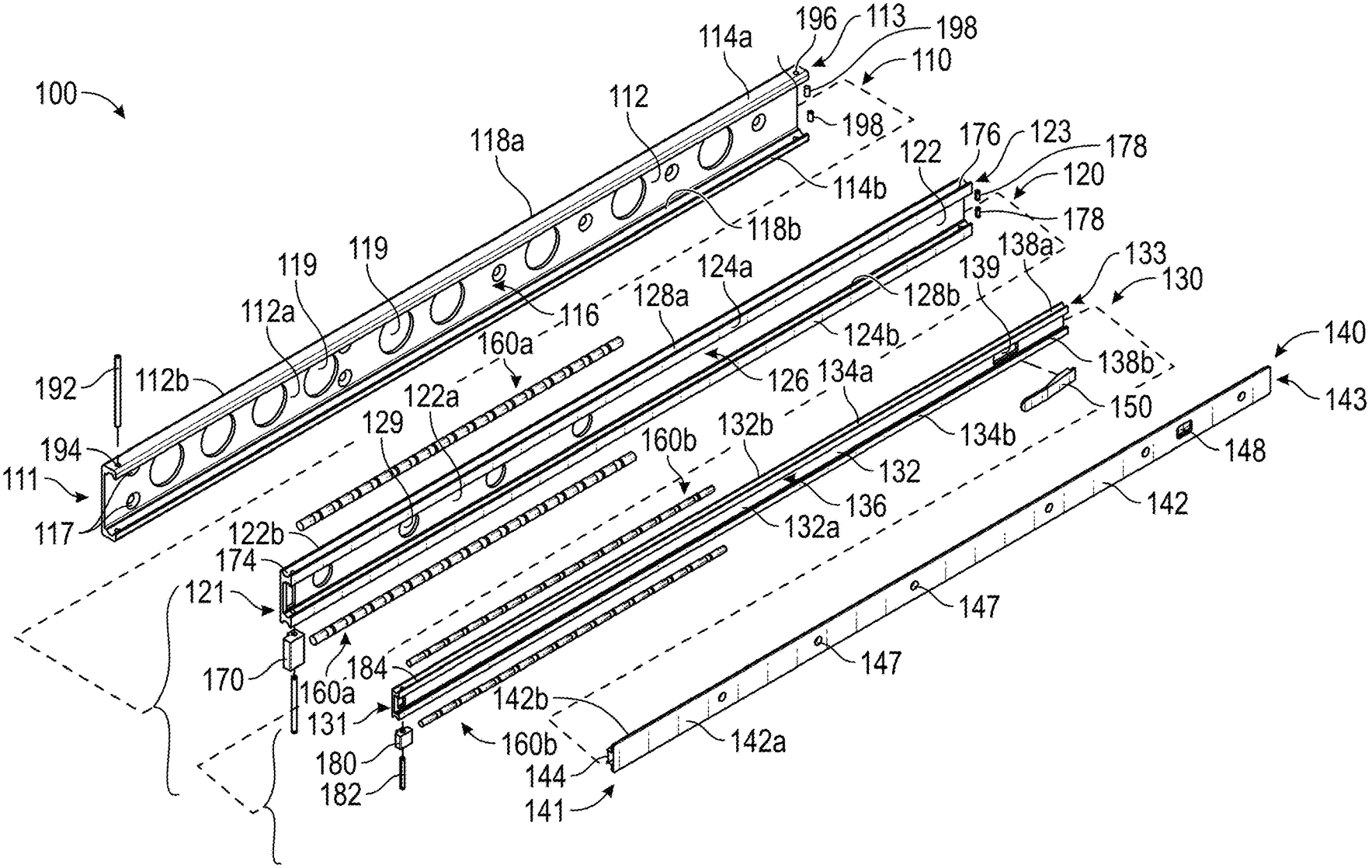
FIG. 4 illustrates an exploded view of the slide assembly shown in FIG. 1.

As shown in FIG. 4, the inner slide segment 130 may include a wall portion 132 (also referred to herein as a web) configured to be received within the receiving portion 126 of the intermediate slide segment 120. The web 132 may have an inner surface 132*a* and an outer surface 132*b* opposite the inner surface 132*a*. The web 132 may be generally rectangular in shape. The inner and outer surfaces 132*a*, 132*b* of the web 132 may be generally planar and parallel to each other. Although not shown, the web 132 may include one or more weight reducing features such as indentations or holes to reduce a total weight of the inner slide segment 130.

The inner slide segment 130 may also include a first flange 134*a* and a second flange 134*b* extending from the inner surface 132*a* of the web 132, for example perpendicular to the inner surface 132*a* of the web 132. The first and second flanges 134*a*, 134*b* may be spaced apart by the web 132 providing a receiving portion 136 therebetween. Each of the first flange 134*a* and the second flange 123*b* may include an outer surface 138*a* and an inner surface 138*b* facing the space 136. The inner surfaces 138*b* and/or outer surfaces 138*a* of the first and second flanges 134*a*, 134*b* may be include a curvature, for example a concave curvature. The curvature of the outer surfaces 138*a* may constrain and/or guide the bearings 160 described further below.

When assembled, the outer surface 132*b* of the inner slide segment 130 faces the inner surface 122*a* of the intermediate slide segment 120. A height of the inner slide segment 130, measured from the first flange 134*a* to the second flange 134*b*, may be dimensioned to fit within the receiving portion 126 between the first and second flanges 124*a*, 124*b* of the intermediate slide segment 120.

As explained above, the slide assembly 100 may also include a chassis member 140 configured to be mounted to a second object such as a drawer. The chassis member 140 may include one or more mounting structures 147, such as holes, projections, hooks or otherwise, for mounting the chassis member 140 to the second object. The chassis member 140 may be removably or non-removably coupled to the inner slide segment 130. As illustrated, the receiving portion 136 of the inner slide segment 130 receives and retains at least a portion of the chassis member 140. However, in other configurations, the chassis member 140 may receive the inner slide segment 130.

Figure 5:
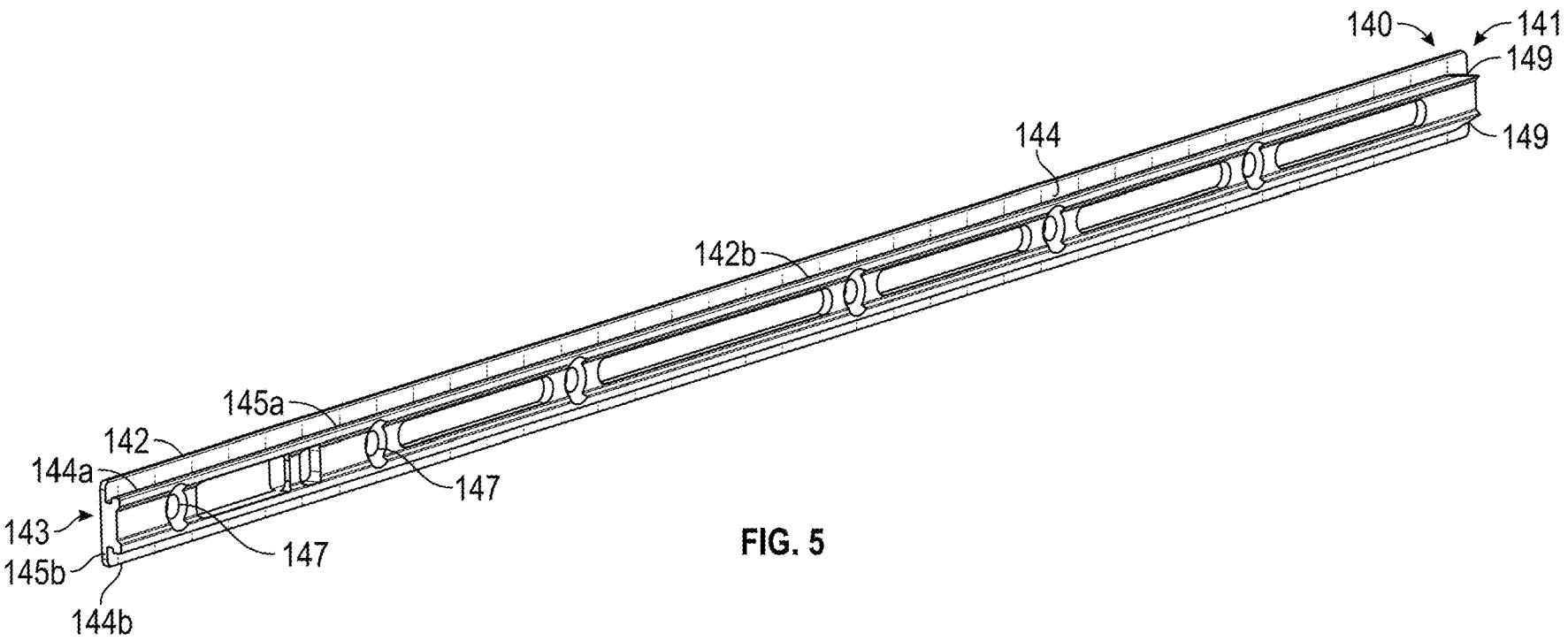
FIG. 5 illustrates a chassis of the slide assembly shown in FIG. 1.

The chassis member 140 may include a support structure 142 having a first side 142*a* facing the second object and a second side 142*b* facing the inner slide segment 130, in use. As shown in FIG. 5, the chassis member 140 may also include an engagement structure 144 extending from the second side 142*b* of the chassis member 140. The engagement structure 144 of the chassis member 140 may be received by the receiving portion 136 of the inner slide segment 130.

Figure 6:
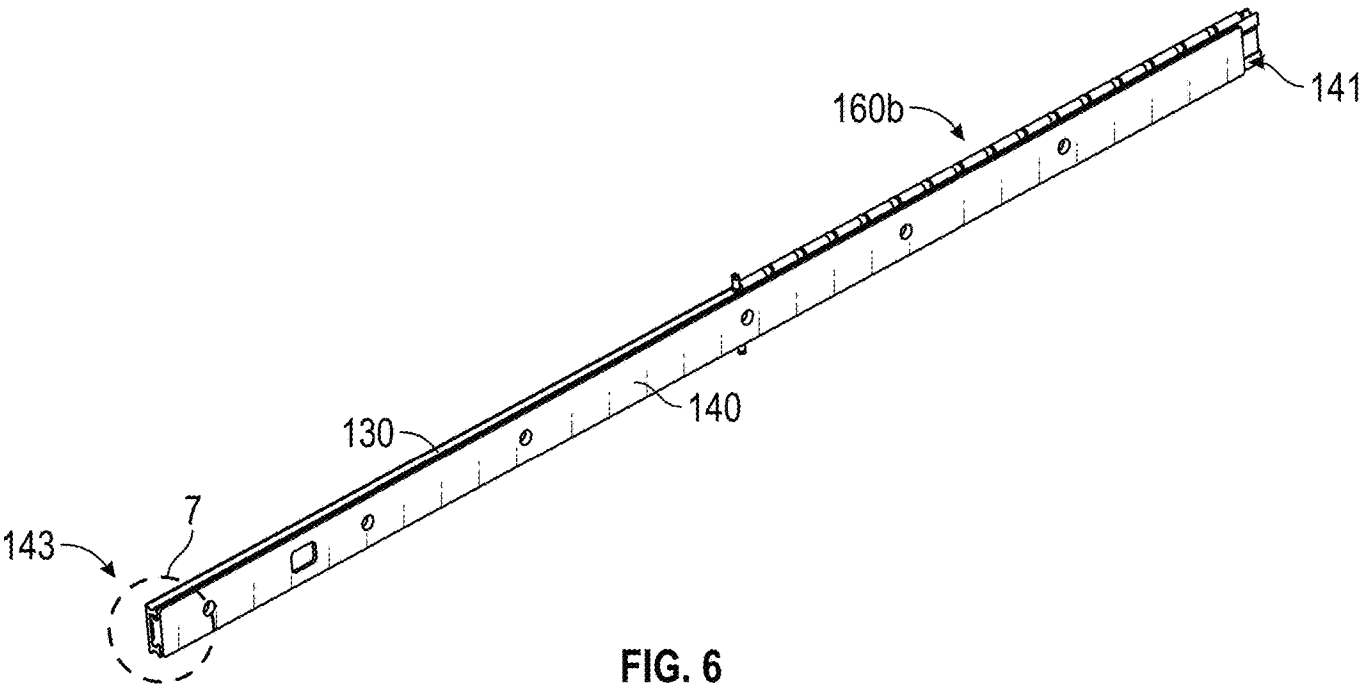
FIG. 6 illustrates an inner slide segment and a chassis of the slide assembly shown in FIG. 1.
Figure 7:
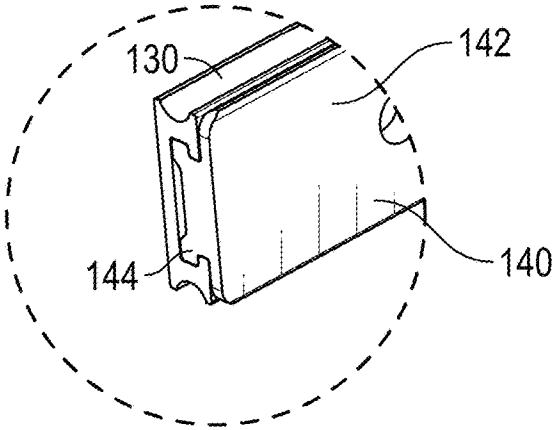
FIG. 7 illustrates an enlarged end view of FIG. 6 taken through line 7-7.

As illustrated, the inner slide segment 130 and the chassis member 140 form a tongue and groove connection (see FIGS. 6 and 7). At least a portion of the engagement structure 144 may include a first prong 144*a* and a second 144*b* extending in opposite directions. The first and second prongs 144*a*, 144*b* may form respective grooves 145*a*, 145*b* between the engagement structure 144 and the support structure 142. The first and second prongs 144*a*, 144*b* of the chassis member 140 may interface with each of the inner surfaces 138*b* of the inner slide segment 130, while the flanges 134*a*, 134*b* of the inner slide segment 130 interface with the grooves 145*a*, 145*b* in the chassis member 140. The engagement structure 144 at the rear end 141 of the chassis member 140 may have a different configuration than the front end 143 of the chassis. For example, the engagement structure 144 may include one or more tapered surfaces 149 at the rear end 141 of the chassis member 140 to facilitate insertion into the inner slide segment 130. As illustrated, the chassis member 140 and the inner slide segment 130 are separate components, but in other configurations, one or more features of the chassis member 140 may be integrated into the inner slide segment 130.

Figure 8:
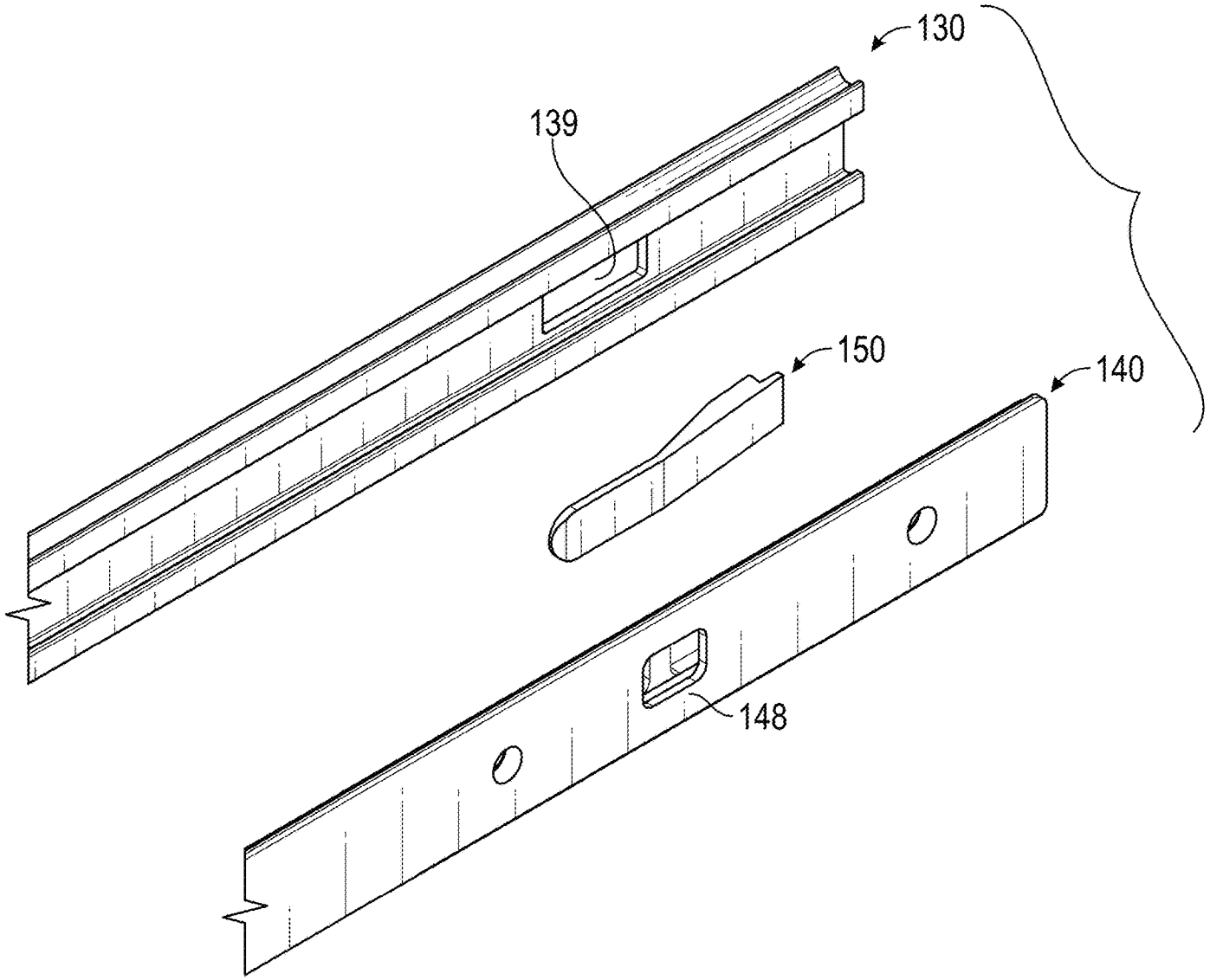
FIG. 8 illustrates an exploded view of a latch arrangement of the slide assembly shown in FIG. 1.

In use, the second object (e.g., drawer) is secured to the chassis member 140, so the second object can be easily and quickly removed from the remainder of the slide assembly 100 by removing the chassis member 140 and second object from the inner slide segment 130. The slide assembly 100 may also include additional attachment features to facilitate the connection between the inner slide segment 130 and the chassis member 140. For example, the slide assembly 100 may include a latch 150 carried by the inner slide segment 130 or the chassis member 140 and configured to removably engage the other of the inner slide segment 130 or the chassis member 140. In the illustrated arrangement, the latch 150 is carried by the inner slide segment 130. For example, the inner slide segment 130 may include a retaining structure 139, such as an opening, projection, hook, or otherwise, configured to retain the latch 150 (see FIG. 8). The latch 150 engages an opening 148 in the chassis member 140 to prevent unintentional or undesired removal of the chassis member 140 from the slide assembly 100. The latch 150 may be actuated to disengage the latch 150 from the chassis member 140. The latch 150 can be of any suitable arrangement, such as a resilient arm or a pivotally-supported latch.

The slide assembly 100 may be designed to be lightweight for the given load capacity and, thus, can be constructed from plastic and/or light weight metal. For example, at least some or all components of the slide assembly 100, such as one or more slide segments 110, 120, 130, 140, may be constructed from plastic. In some embodiments, the slide assembly 100 may include a combination of plastic and metal slide segments. For example, the outer slide segment 110, inner slide segment 130, and/or plastic chassis member 140 may include plastic, while the intermediate slide segment 120 may include metal. Other combinations of plastic and metal segments is also possible.

The plastic material may include an aircraft grade plastic and meet the burn, fume, and toxic emission standards for aircraft flight requirements, including FAR 25.562 specification.

The metal material may include a lightweight metal such as aluminum. One or more slide segments 110, 120, 130, 140 may be formed by an extrusion, molded, or other similar or suitable process into a final or near-final cross-sectional shape. As explained above, weight reducing features, such as indentations or holes may be provided throughout any portion or all of a length of the individual slide segments of the slide assemblies to further reduce weight.

Providing the combination of plastic and metal slide segments enables the slide assembly 100 to remain light weight but still achieve higher loading capabilities. For example, the inner slide segment 130 may over travel the outer slide segment 110 while carrying up to or at least a 50 pound load. Further, the inner slide segment 130 may carry up to or at least two times the working load as a momentary load in the extended position. For a slide assembly rated at a 50 pound load, the slide assembly will have at least a 100 pound safety factor load.

The slide assemblies can be of any desired length, for example in the collapsed configuration. A length of each of the intermediate slide segment 120, inner slide segment 130, and/or the chassis member 140 (measured in the direction L shown in FIG. 3) may be less than a length of the outer slide segment 110 such that when the slide assembly 100 is in the collapsed configuration, an entire length of the intermediate slide segment 120, the inner slide segment 130, and/or the chassis member 140 is positioned within the receiving portion 116 of the outer slide segment 110. In the collapsed configuration, the slide assembly 100 may have a length of at least about 12 inches and/or less than or equal to about 30 inches. For example, the slide assembly 100 may have a length of greater than or equal to about 30 inches.

The slide assembly 100 may also have any desired travel distance. For example, the inner slide segment may travel at least 8 inches, at least 16 inches, or at least 24 inches. As shown in FIGS. 1 and 2, the inner slide segment 130 may be configured to over travel the outer slide segment 110 in the extended configuration. In other words, in the extended configuration, a rear end 131 of the inner slide segment 130 is forward of the front end 113 of the outer slide segment 130. For example, the inner slide segment 130 may be configured to over travel the outer slide segment 110 by at least 1 inch, while still carrying the loads described above.

A height of the slide assembly 100 (measured in the direction H shown in FIG. 3) may be sized to fit within a 1U EIA rack spacing requirement. For example, the height H may be less than or equal to about 1.75 inches. A width of the slide assembly 100 (measured in the direction W shown in FIG. 3) may be less than or equal to about 0.5 inches. A height of the chassis member 140 may be less than 50%, or less than 40%, of the height of the outer slide segment 110.

Figure 10:
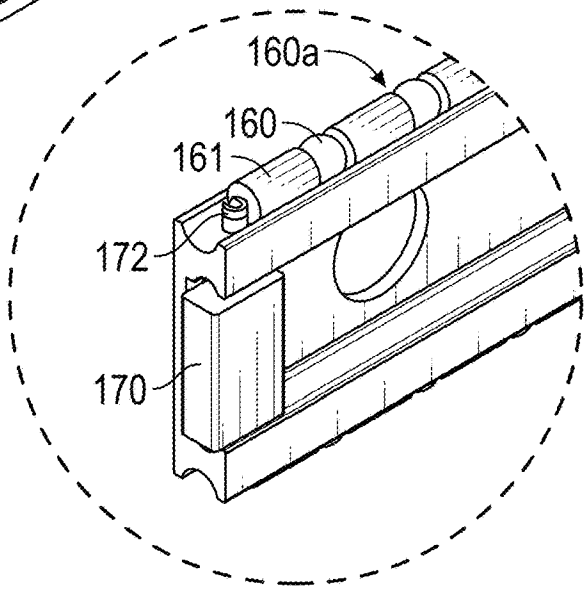
FIG. 10 illustrates a partial enlarged view of the intermediate slide segment shown in FIG. 9.
Figure 9:
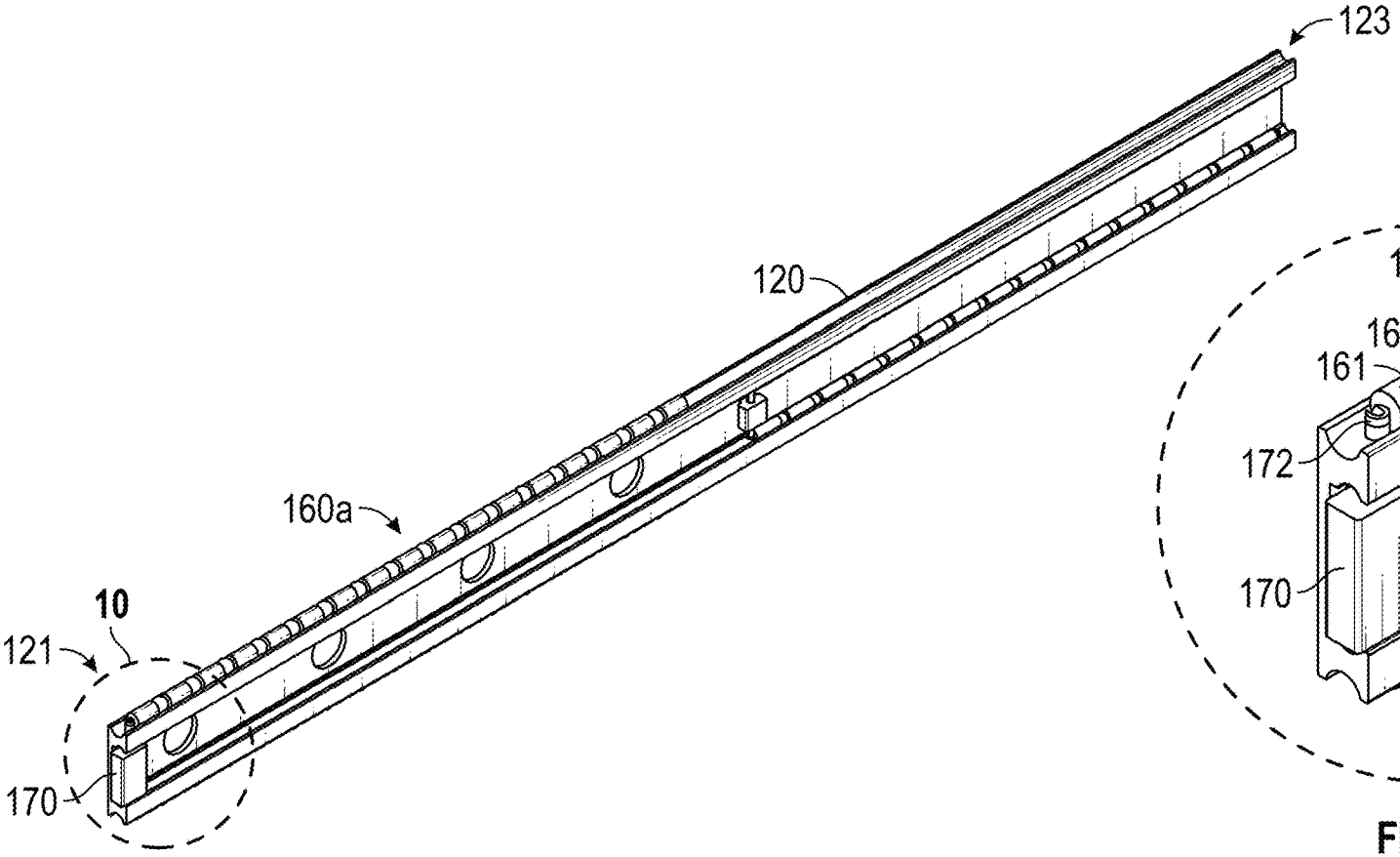
FIG. 9 illustrates an intermediate slide segment of the slide assembly shown in FIG. 1.
Figure 11:
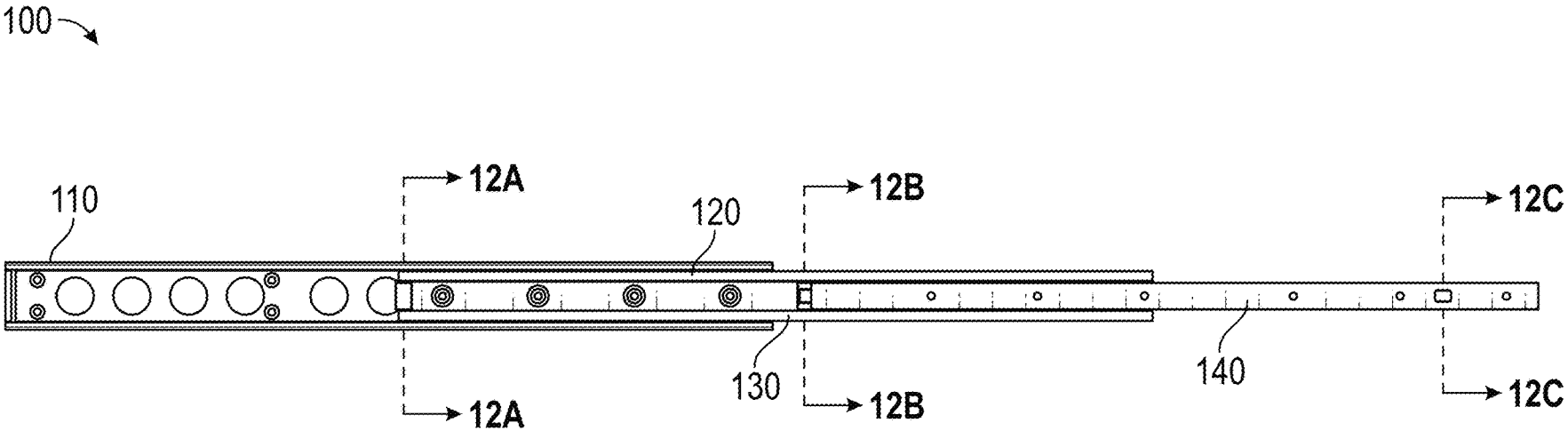
FIG. 11 illustrates a side elevation view of the slide assembly shown in FIG. 1.

As discussed above, the outer slide segment 110, the intermediate slide segment 120, and the inner slide segment 130 slide relative to each other. For example, the slide assembly 100 may include bearings 160 (e.g., ball bearings, rollers, and/or other suitable arrangements) interposed between the slide segments 110, 120, 130 to facilitate smooth relative movement therebetween. The individual bearings 160 may be constructed from a polymer material to provide a lightweight slide assembly. In other embodiments, the individual bearings 160 may be constructed from a metal material such as stainless steel. The individual bearings 160 may be spaced from one another by carriers 161 or interconnected by a single carrier (see FIG. 10). However, in other arrangements, the slide segments 110, 120, 130 can slide directly on one another without any bearing arrangement.

The intermediate slide segment 120 moves relative to the outer slide segment 110 by a first set of bearings 160*a*. Bearings 160*a* are provided between respective flanges 124*a*, 124*b* and flanges 114*a*, 114*b*, for example between the outer surfaces 128*a* of the first and second flanges 124*a*, 124*b* and the inner surfaces 118*b* of the first and second flanges 114*a*, 114*b*.

The inner slide segment 130 moves relative to the intermediate slide segment 120 by a second set of bearings 160*b*. Bearings 160*b* are provided between respective flanges 134*a*, 134*b* and flanges 124*a*, 124*b*, for example between the outer surfaces 138*a* of the first and second flanges 134*a*, 123*b* and the inner surfaces 128*b* of the first and second flanges 124*a*, 124*b*.

Forward and/or rearward bearing stops may be provided in the path of the bearings 160 to retain the bearings 160 from becoming dislodged from the slide assembly 100. For example, each rear bearing stops may include one or more pins 172, 182. The pins 172, 182 may include a metal such as stainless steel. The first pin 172 may extend through one or more openings 174 in the first and second flanges 124*a*, 124*b* of the intermediate slide segment 120, for example at the rear end 121, to act as a rear stop of first set of bearings 160*a* (see FIG. 10). The second pin 182 may extend through one or more openings 184 in the first and second flanges 134*a*, 134*b* of the inner slide segment 130, for example at the rear end 131, to act as a rear stop to the second set of bearings 160*b*.

Figure 12C:
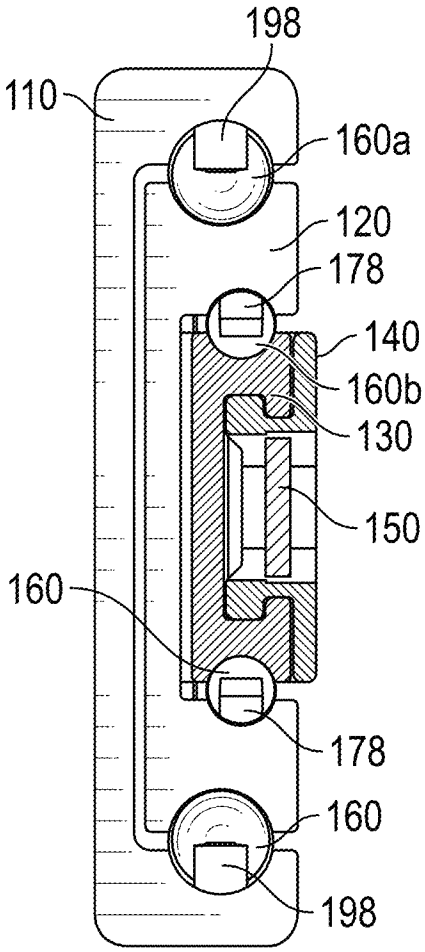
FIG. 12C illustrates a cross-section of the slide assembly shown in FIG. 11 taken along line 12C-12C.
Figure 12B:
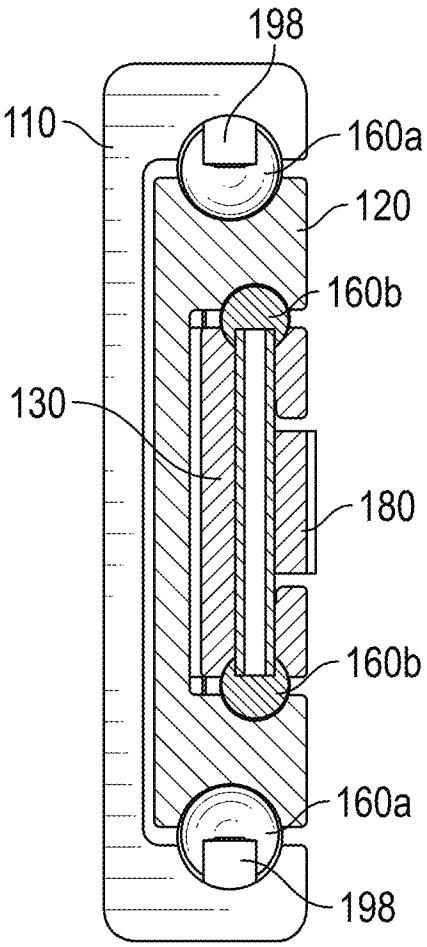
FIG. 12B illustrates a cross-section of the slide assembly shown in FIG. 11 taken along line 12B-12B.
Figure 12A:
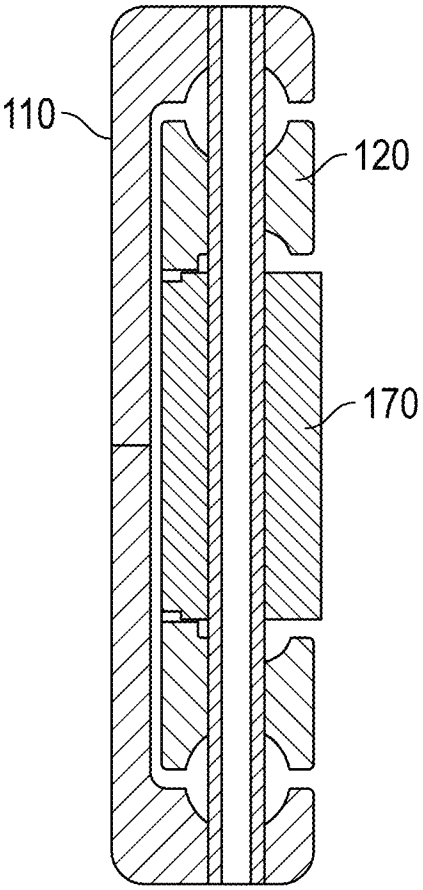
FIG. 12A illustrates a cross-section of the slide assembly shown in FIG. 11 taken along line 12A-12A.

Each forward bearing stop may include one or more pins 198, 178, for example each bearing stop may include a pair of pins. The pins 198, 178 may include a metal such as stainless steel. Each of the first pair of pins 198 may extend through an opening 196 in the first and second flanges 114*a*, 114*b* of the outer slide segment 110, for example at the forward end 113, to act as a forward stop of first set of bearings 160*a* (see FIG. 12B). Each of the second pair of pins 182 may extend through one or more openings 176 in the first and second flanges 124*a*, 124*b* of the intermediate slide segment 120, for example at the forward end 123, to act as a forward stop to the second set of bearings 160*b* (see FIG. 12C).

The slide assembly 100 may include one or more position stops 170, 180 to provide a cushioned stop. The position stops 170, 180 may be constructed from a relatively soft material (e.g., elastomeric material) to soften and/or reduce the noise of the closure of the slide assembly 100. The first position stop 170 may extend between the flanges 124*a*, 124*b* at a rear end 121 of the intermediate slide segment 120. For example, the first position stop 170 may be carried by the first pin 172. The first position stop 170 may be positioned to contact the rear pin 192 of the outer slide segment 100 in the closed position of the slide assembly 100. The second position stop 180 may extend between the flanges 134*a*, 134*b* at a rear end 131 of the inner slide segment 130. For example, the second position stop 180 may be carried by the second pin 182. The second position stop 180 may be positioned to contact the first position stop 170 in the closed position of the slide assembly 100.

Terminology

Although certain embodiments and examples have been described herein, it will be understood by those skilled in the art that many aspects of the delivery systems shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements, and/or states. Thus, such conditional language is not generally intended to imply that features, elements, blocks, and/or states are in any way required for one or more embodiments or that one or more embodiments necessarily include logic for deciding, with or without author input or prompting, whether these features, elements and/or states are included or are to be performed in any particular embodiment.

The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers and should be interpreted based on the circumstances (e.g., as accurate as reasonably possible under the circumstances, for example ±1%, ±5%, ±10%, ±15%, etc.). For example, "about 12 inches" includes "12 inches." Phrases preceded by a term such as "generally" include the recited phrase and should be interpreted based on the circumstances (e.g., as much as reasonably possible under the circumstances). For example, "generally parallel" includes "parallel."

What is claimed is:

1. A slide assembly, comprising:

an aircraft grade plastic outer slide segment having a web, a first flange, a second flange opposite the first flange, and a space defined between the first flange and the second flange, the web of the outer slide segment being mountable to a first object;

an aluminum alloy intermediate slide segment slideable relative to the outer slide segment, the intermediate slide segment having a web, a first flange, a second flange opposite the first flange, and a space defined between the first flange and the second flange, the web of the intermediate slide segment is received within the space of the outer slide segment;

an aircraft grade plastic inner slide segment slideable relative to the intermediate slide segment, the inner slide segment having a web, a first flange, a second flange opposite the first flange, and a receiving portion defined between the first flange and the second flange, the web of the inner slide segment is received within the space of the intermediate slide segment; and an aircraft grade plastic chassis member removably coupled to the inner slide segment, the receiving portion of the inner slide segment configured to retain the chassis member, the chassis member being mountable to a second object.

2. The slide assembly of claim 1, wherein the chassis member comprises a support structure having a first side facing the inner slide segment and a second side facing the second object, the chassis member further comprising an engagement structure extending from the first side of chassis member.

3. The slide assembly of claim 2, wherein the engagement structure on the chassis member and the receiving portion on the inner slide segment form a tongue and groove connection.

4. The slide assembly of claim 1, wherein one of the inner slide segment or the chassis member comprises a latch configured to engage the other one of the inner slide segment or the chassis member.

5. The slide assembly of claim 1, wherein the slide assembly is configured to move between a first configuration in which the web of the inner slide segment is received within the space of the outer slide segment and a second configuration in which the web of the inner slide segment is not received within the space of the outer slide segment.

6. The slide assembly of claim 5, wherein in the second configuration, one end of the inner slide segment is configured to be displaced from one end of the outer slide segment by up to one inch.

7. The slide assembly of claim 5, wherein in the second configuration, the metal intermediate slide segment is configured so that the inner slide segment can carry up to a 50 pound load.

8. The slide assembly of claim 1, further comprising a first set of bearings positioned in the first flange and/or the second flange of the outer slide segment such that the intermediate slide segment slides relative to the outer slide segment.

9. The slide assembly of claim 8, further comprising at least one pin extending from the first flange or the second flange of the outer slide segment and extending into the space defined in the outer slide segment, the at least one pin configured to stop movement of the first set of bearings.

10. The slide assembly of claim 1, wherein the first set of bearings comprises polymer bearings.

11. The slide assembly of claim 1, further comprising a second set of bearings positioned in the first flange and/or the second flange of the intermediate slide segment such that the inner slide segment slides relative to the intermediate slide segment.

12. The slide assembly of claim 11, further comprising at least one pin extending from the first flange or the second flange of the intermediate slide segment and extending into the space defined in the outer slide segment, the at least one pin configured to stop movement of second first set of bearings.

13. The slide assembly of claim 11, wherein the second set of bearings comprises polymer bearings.

14. The slide assembly of claim 1, wherein the metal intermediate slide segment is configured to enable the slide assembly to provide at least 10,000 cycles.

15. The slide assembly of claim 1, further comprising a position stop at an end of the intermediate slide segment and/or the inner slide segment.

16. A slide assembly, comprising:

an aircraft grade plastic outer slide segment having a web, a first flange, a second flange opposite the first flange, and a space defined between the first flange and the second flange, the web of the outer slide segment being mountable to a first object;

an aluminum alloy intermediate slide segment slideable relative to the outer slide segment, the intermediate slide segment having a web, a first flange, a second flange opposite the first flange, and a space defined between the first flange and the second flange, the web of the intermediate slide segment is received within the space of the outer slide segment; and an aircraft grade plastic inner slide segment slideable relative to the intermediate slide segment, the inner slide segment having a web, a first flange, a second flange opposite the first flange, and a receiving portion defined between the first flange and the second flange, the web of the inner slide segment is received within the space of the intermediate slide segment;

wherein the inner slide segment is configured over travel the outer slide segment by up to one inch.

17. The slide assembly of claim 16, wherein in the second configuration, the metal intermediate slide segment is configured so that the inner slide segment can carry up to a 50 pound load.

18. The slide assembly of claim 16, wherein in the second configuration, the metal intermediate slide segment is configured so that the inner slide segment can carry at least a 100 pound load.

19. The slide assembly of claim 16, wherein in the first configuration, the slide assembly has a length between about 12 inches and about 30 inches.

20. A slide assembly, comprising:

an aircraft grade plastic outer slide segment having a web, a first flange, a second flange opposite the first flange, and a space defined between the first flange and the second flange, the web of the outer slide segment being mountable to a first object;

an aluminum alloy intermediate slide segment slideable relative to the outer slide segment, the intermediate slide segment having a web, a first flange, a second flange opposite the first flange, and a space defined between the first flange and the second flange, the web of the intermediate slide segment is received within the space of the outer slide segment; and an aircraft grade plastic inner slide segment slideable relative to the intermediate slide segment, the inner slide segment having a web, a first flange, a second flange opposite the first flange, and a receiving portion defined between the first flange and the second flange, the web of the inner slide segment is received within the space of the intermediate slide segment;

a first set of polymer bearings positioned in the first flange and/or the second flange of the outer slide segment such that the intermediate slide segment slides relative to the outer slide segment; and a second set of polymer bearings positioned in the first flange and/or the second flange of the intermediate slide segment such that the inner slide segment slides relative to the intermediate slide segment.

21. The slide assembly of claim 20, further comprising at least one pin extending from the first flange or the second flange of the outer slide segment and extending into the space defined in the outer slide segment, the at least one pin configured to stop movement of the first set of bearings.

22. The slide assembly of claim 20, further comprising at least one pin extending from the first flange or the second flange of the intermediate slide segment and extending into the space defined in the outer slide segment, the at least one pin configured to stop movement of second first set of bearings.

* * * * *